United States Patent [19]

Bodine

[11] Patent Number: 4,673,037

[45] Date of Patent: Jun. 16, 1987

[54] METHOD FOR SONICALLY LOOSENING OIL WELL LINER ENVIRONMENTS

[76] Inventor: Albert G. Bodine, 7877 Woodley Ave., Van Nuys, Calif. 91406

[21] Appl. No.: 783,460

[22] Filed: Oct. 3, 1985

[51] Int. Cl.[4] ..... E21B 31/00

[52] U.S. Cl. ..... 166/249; 166/72; 166/177; 166/301

[58] Field of Search ..... 166/72, 98, 177, 249, 166/301, 311, 312; 175/55, 56

[56] References Cited

U.S. PATENT DOCUMENTS

| | | | |
|---|---|---|---|
| Re. 23,381 | 6/1951 | Bodine | 166/249 |
| 2,680,485 | 6/1954 | Bodine | 166/177 X |
| 2,918,126 | 12/1959 | Bodine | 166/249 |
| 4,236,580 | 12/1980 | Bodine | 166/301 |
| 4,280,557 | 7/1981 | Bodine | 166/249 X |
| 4,342,364 | 8/1982 | Bodine | 166/177 X |
| 4,466,486 | 8/1984 | Walker | 166/301 |
| 4,574,888 | 3/1986 | Vogen | 175/56 X |

*Primary Examiner*—George A. Suchfield
*Attorney, Agent, or Firm*—Edward A. Sokolski

[57] ABSTRACT

A column of elastic material such as steel is lowered into an oil well by means of a derrick to a position such that the end portion thereof is within a liner to be removed. An acoustic coupling surface such as a plurality of annular piston-like members made of a resilient material such as a suitable rubber or plastic are fitted onto a portion of the column which extends into the interior of the lining, these annular members being spaced from each other along the column. An annulus of liquid is maintained in the spaces formed between successive annular members. High level sonic energy is applied to the column from the surface and transmitted along the column to the liner and liquid through the acoustic coupling means. Such energy is also fed to the liquid annuli and then to the liquid environment between the liner and the surrounding formation. The application of sonic energy both to the liner along with the liquid environment of the liner operates to effectively loosen the liner and its environment. The sonic energy may be applied simultaneously both to the liquid environment and directly to the liner, or such application of sonic energy can be done separately.

5 Claims, 2 Drawing Figures

METHOD FOR SONICALLY LOOSENING OIL WELL LINER ENVIRONMENTS

Figure 1A:
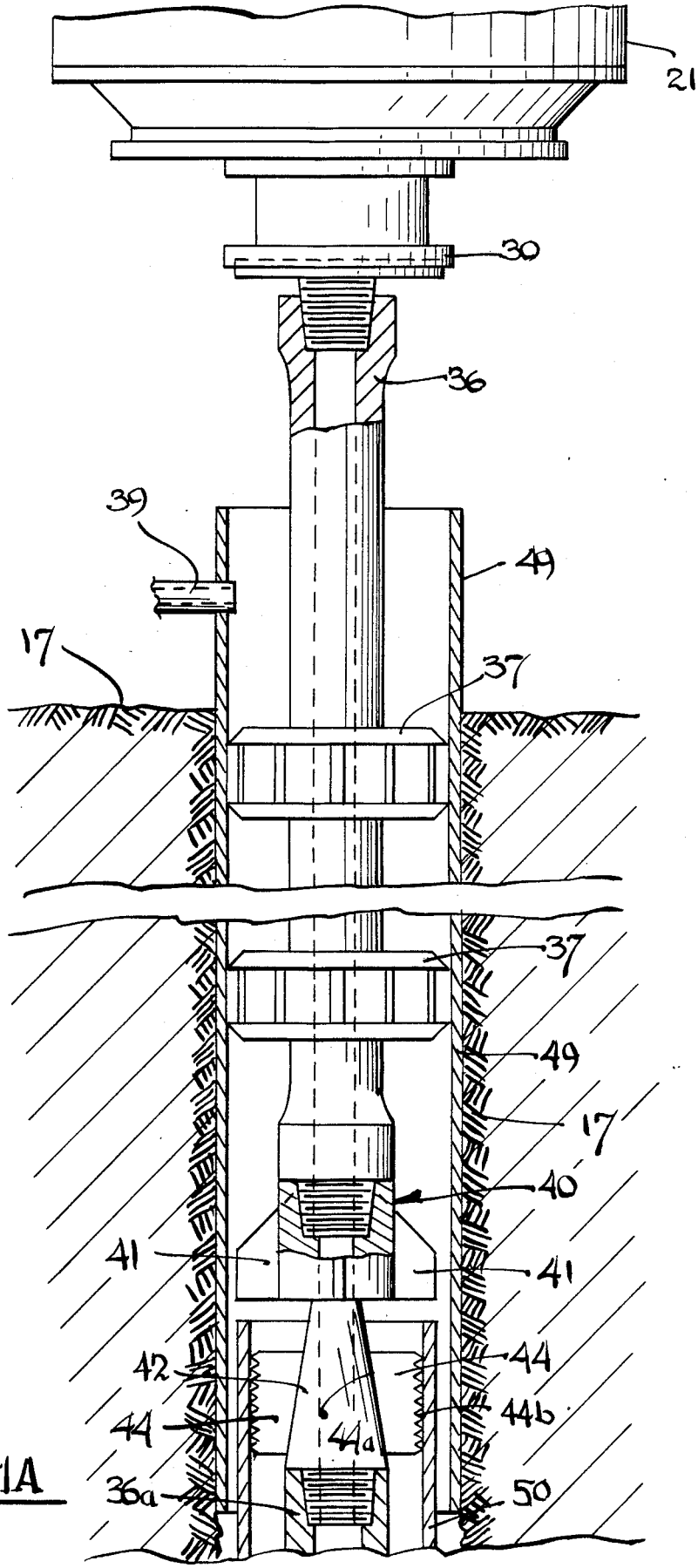

This invention relates to a method for loosening of the liner environment around wells and more particularly, to such a method wherein sonic energy is applied to the liner and to the environment surrounding such liner.

In my U.S. Pat. No. 4,236,580, issued Dec. 2, 1980, a method is described for removing an oil well liner lodged at the bottom of an oil well casing by applying sonic energy to the liner. In carrying out this method, an elongated elastic steel column having a clamping tool at the bottom end thereof, is lowered through the oil well casing until the clamping tool is within the liner; the clamping tool being employed to tightly clamp the elastic column to the liner. High level sonic energy which may be generated by an orbiting mass oscillator is then applied to the liner through the column in a longitudinal mode of vibration, with the frequency of the oscillator preferably being adjusted so as to cause resonant standing wave vibration of the column. The column is supported by a derrick and various amounts of vertical bias are intermittently applied to the column by changing the lift thereon applied by means of the derrick. By virtue of the sonic energy combined with the varying vertical force applied to the liner, the liner is freed from the formation so that it can be drawn out of the well.

The method of the present invention is an improvement over that of my aforementioned patent wherein the loosening of the liner and particularly its surrounding environment is facilitated by applying sonic energy to the liquid medium in the liner and formation and between the two.

The disclosure of my aforementioned U.S. Pat. No. 4,236,580 is incorporated herein by reference, the apparatus and method of the present invention being the same as that of my prior patent insofar as the generation of the sonic energy and its direct coupling to the liner is concerned. The present invention adds to the method of that disclosure, the application of sonic energy to the environment surrounding the liner.

Briefly described, the method of the present invention involves the removal or loosening up of a damaged or plugged oil well liner embedded in an earthen formation at the bottom of a well by applying sonic energy both directly to the liner and/or to the environment surrounding the liner. This end result is achieved by lowering by means of a derrick, a column of an elastic material such as steel drill pipe through the oil well casing down into the liner. The elastic column may have a clamping mechanism thereon, which operates to tightly clamp the column to the liner when upward bias is applied by the derrick to the column, and which will release from such tight clamping action when downward bias is applied to the column which can be accomplished by virtue of the weight of the column when the upward pull of the derrick is released. Portions of the column, which extend within the liner, have a plurality of annular elastic "piston" members spaced thereon, these piston members being fabricated of a material such as rubber or a suitable plastic and fitting slideably within the casing. High level sonic energy is applied to the column to cause the column to vibrate in a vertical vibration mode. The frequency of vibration may be adjusted such as to cause resonant vibration of the column. The application of sonic energy directly to the liner while at the same time applying sonic energy to the liquid within the liner surrounding the column, this energy also being transferred through the liner slots to the outside wall of the liner, operates to rapidly loosen the liner from the formation to aid production therethrough or to enable the liner's removal therefrom. In certain instances it may be desirable to apply the sonic energy both directly to the liner and to the liquid medium simultaneously, while however in other situations these two steps can best be performed separately or totally independently. It is to be noted that in addition to the sonic "lubrication" achieved through the liquid medium being sonically activated between the liner and the formation, the same energy also acts uniquely on the inside surface of the liner causing the liner structure to dilate circumferentially in response to the elastic vibration which effectively momentarily forms spaces between the outside wall of the liner and the formation and thus facilitates the entry of additional liquid into these annular spaces thus further facilitating the looseness of everything. It is further to be noted that there is a cooperative interaction between the application of sonic energy directly to the liner and to the liquid in that as liquid tends to undesirably migrate into the formation and away from intimate contact with the outer surface of the liner, the sonic energy applied directly to the liner while the liner is being pulled upwardly tends to keep the desirable lubricating liquid layer distributed and retained along the liner outside surface. The sonically moving liner tends to retain the liquid layer like the wiping action of a bearing.

It is therefore an object of this invention to provide an improved sonic technique for removing oil well liners.

It is a further object of this invention to provide a method for loosening oil well liners and the environment therearound in which sonic energy is applied to the liner and/or to the liquid medium between the liner and the earthen formation in which it is embedded.

Figure 1B:
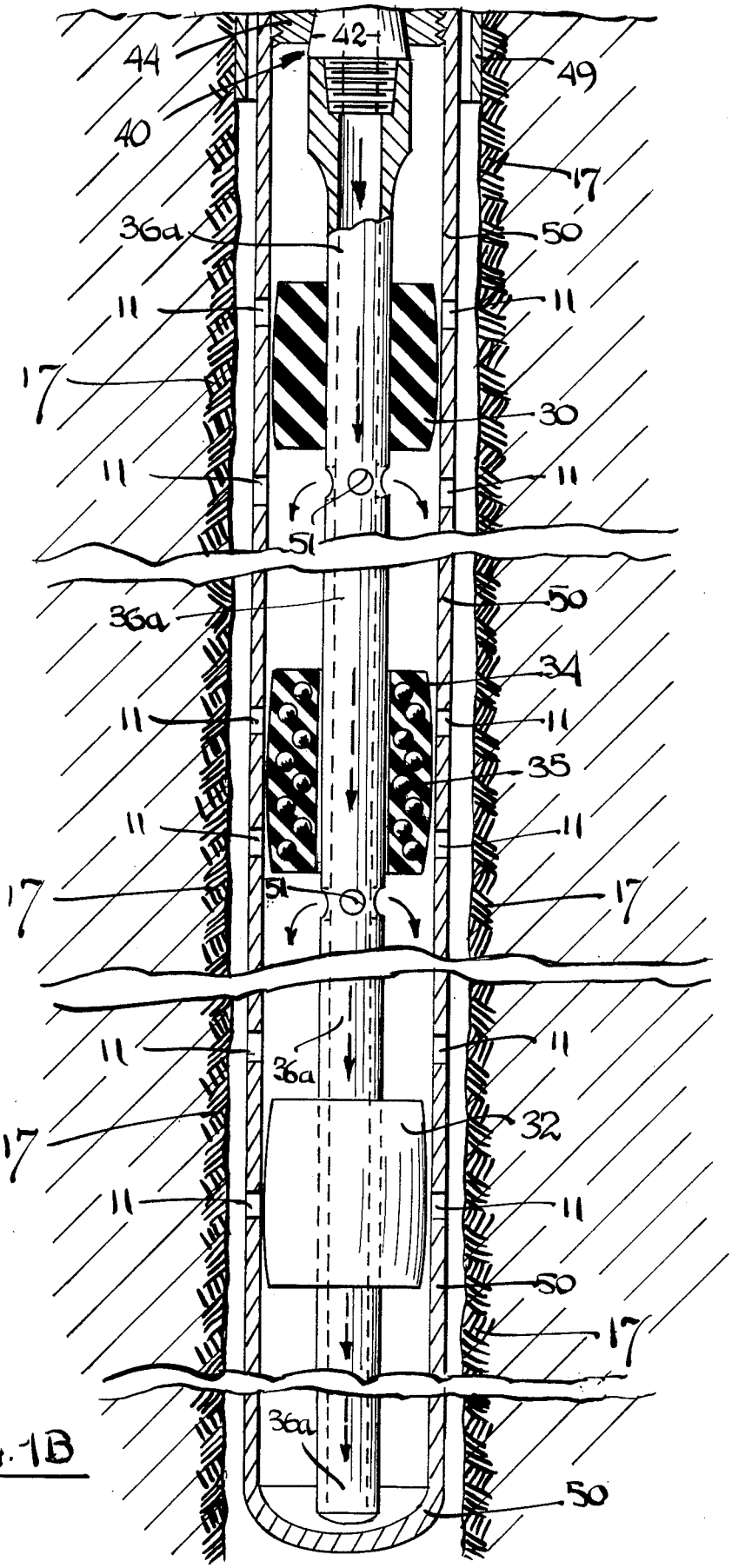

Other objects of this invention will become apparent as the description proceeds in connection with the accompanying drawings of which:

FIGS. 1A and 1B are cross-sectional views illustrating apparatus for carrying out the method of the invention.

As already noted, a substantial part of the apparatus employed in the present invention to carry out the method thereof is the same as that described in my aforementioned U.S. Pat. No. 4,236,580 which is incorporated herein by reference. Therefore, this structure will be but briefly described herein. An orbiting mass oscillator is housed within housing 21, this orbiting mass oscillator being of the type described in my U.S. Pat. No. 4,236,580 and driven and suspended by drive and suspension units (not shown) in the same manner as in that patent. The vibrational output of the oscillator housing 21 is coupled through threaded flange 30 to the end of elastic column 36, which is fabricated of an elastic material such as steel. Elastic column 36 is lowered through well casing 49 down into well liner 50 which is to be removed from earthen formation 17.

Column 36 has a coupling tool 40 attached thereto with a conical wedge member 42. A pair of slip jaws 44 are slidably supported on member 42, these slip jaws having half conical inner surfaces **44*a* which matingly engage the conical walls of member 42. Jaws 44 have outer serrated wall portions 44*b* which are generally semi-circular in form. Threadably attached to the end of wedge member 42 is column extension 36***a*. This column extension has as one form of acoustic liquid coupling surface a plurality of annular piston like members 30, 32 and 34 installed at spaced intervals therealong. Liquid acoustic coupling may also be effected by closing the bottom end at 36*a* as shown. The annular "pistons" 30, 32 and 34 may be made of a resilient material such as a suitable rubber or plastic, piston 30 being typically five inches in height while pistons 32 and 34 are typically 12 inches high. Pistons 30 and 32 are tightly force fitted on column extension 36*a* while piston 34 is closely but loosely fitted on the column. Piston has lead weighting elements 35 embedded therein to add weight or inertia to the piston. These pistons are similar in configuration to those described in my U.S. Pat. No. 4,342,364 dated Aug. 3, 1982. The spaces between pistons 30, 34, and 32 are filled from column 36*a* with a liquid such as oil, water or polymer lubricant or mixtures thereof, this fluid being free to communicate from the interior of liner 50 though apertures 11 formed therein with the exterior thereof. The adverse effects of buckling vibration which may be engendered by the longitudinal wave action in column 36 is ameliorated by employing rubber bumpers or rings 37 attached to column 36 at spaces therealong. These rubber bumpers also provide guidance stability for the column. Lubricant for the bumpers may be introduced through conduit 39. Also lubricant may be introduced through the slots 11 from orifices 51 which are formed in column extension 36*a*, such fluid being supplied to the top end of column 36.

For simultaneous application of sonic energy, both directly to the liner and to the liquid environment surrounding the liner, a lifting force is applied to the column by means of the derrick attached to oscillator housing 21, thereby causing the wedge member 42 of clamping device 40 to force jaws 44 into tight gripping engagement with the inner surface of liner 50. Longitudinal sonic energy is then applied to column 36, this energy preferably being at a frequency such as to set up resonant elastic vibration of the column. This sonic energy is simultaneously applied in two manners. First, the energy is directly coupled through the jaws 44 to liner 50 to cause vibration thereof. Secondly, the energy is applied by said acoustic coupling surfaces to the liquid surrounding column extension 36*a* and through this liquid to the inner and outer walls of liner 50 effectively lubricating the liner outer walls and also dilating the liner during portions of the vibration cycle which helps loosen the liner from the surrounding earthen formation. This simultaneous action thus greatly facilitates the removal of the liner.

The sonic energy can also be applied directly to the liner or to the liquid in separate steps. This can be accomplished by running the pipe string 36 and 36*a* without clamping device 40 or by releasing the lifting action on the column, so that the column is not tightly coupled to the liner through the spear clamping mechanism and then applying substantially all of the sonic energy through the column via said liquid acoustic coupling to the liquid in the liner. After such loosening of the liner and environment has been completed, a "soaking" time can be allowed, sometimes including an extended time of oil production. Lifting force may be then applied to the column if and when the liner is to be removed and the sonic energy applied directly to the liner.

In loosening rigidly tight liners that have been in place for many years, after sonic energy has been applied to the liner as set forth above, column 36 may be lowered to bring flutes 41 into biased engagement with liner 50 such that sonic energy is coupled from the flutes to the column in the nature of a sonic pile driver. Such pile drive coupling can also be accomplished by engaging the bottom at 36*a* against the bottom of liner 50. This may be done with jaws 44 disengaged from the liner.

While the invention has been described and illustrated in detail, it is to be clearly understood that this intended by way of illustration and example only, and is not to be taken by way of limitation. The spirit and scope of this invention being limited only by the terms of the following claims:

I claim:

1. A method for removing an oil well liner lodged in an earthen formation at the bottom of an oil well casing comprising the steps of:

lowering an elastic elongated column having a clamping tool attached thereto through said casing until said clamping tool is within said liner;

causing said clamping tool to tightly engage the liner;

said clamping tool having a column extension attached thereto which extends therebelow into said liner, said column extension having a plurality of annular elastic members spaced therealong;

coupling high level sonic energy to said column to cause longitudinal vibration thereof, said sonic energy being coupled through said clamping tool directly to said liner;

there being liquid within said liner between said annular members and slots formed in said liner providing fluid communication for said liquid between the inside and outside walls of said liner, sonic energy being transferred from said column liner extension to the liquid within said liner and through said liner slots to liquid along the outside surface of said liner, thereby sonically lubricating the outside walls of said liner while sonic energy is being applied directly to the liner;

when said liner is freed from the formation, drawing it out from said well.

2. The method of claim 1 wherein prior to the tool being caused to engage said liner the sonic energy is first applied principally to the liquid in said liner to lubricate the liner wall.

3. The method of claim 1 wherein while the sonic energy is being applied to the column, additional lubricating liquid is introduced to said column, said liquid being fed from the column extension to the outside walls of said liner thereby providing additional lubrication therefor.

4. The method of claim 1 wherein after the sonic energy is applied to the liner through the clamping tool, the clamping tool is released from the liner and the elongated column is biased directly against the liner while sonic energy is being applied to the column.

5. The method of claim 1 wherein the clamping tool is caused to tightly engage the liner by lifting upwardly on said column, said clamping tool having a pair of slip jaws, said clamping tool having a pair of slip jaws, said column having a wedge member.

* * * * *